US007337510B2

(12) United States Patent
Yamagishi et al.

(10) Patent No.: US 7,337,510 B2
(45) Date of Patent: Mar. 4, 2008

(54) SLIDER FOR SLIDE FASTENER PROVIDED WITH AUTOMATIC LOCKING DEVICE

(75) Inventors: Koji Yamagishi, Toyama (JP); Keiichi Keyaki, Toyama (JP)

(73) Assignee: YKK Corporation, Tokyo (JP)

( * ) Notice: Subject to any disclaimer, the term of this patent is extended or adjusted under 35 U.S.C. 154(b) by 78 days.

(21) Appl. No.: 11/243,597

(22) Filed: Oct. 5, 2005

(65) Prior Publication Data

US 2006/0075611 A1 Apr. 13, 2006

(30) Foreign Application Priority Data

Oct. 7, 2004 (JP) ..... 2004-294543

(51) Int. Cl.
*A44B 19/30* (2006.01)

(52) U.S. Cl. ..... 24/421

(58) Field of Classification Search ..... 24/418, 24/420–422, 424, 425
See application file for complete search history.

(56) References Cited

U.S. PATENT DOCUMENTS 2,569,298 A * 9/1951 Erdmann ..... 24/421
3,793,684 A * 2/1974 Moertel ..... 24/421
6,314,624 B1 * 11/2001 Lin ..... 24/421

* cited by examiner

*Primary Examiner*—James R. Brittain
(74) *Attorney, Agent, or Firm*—Alston & Bird LLP

(57) ABSTRACT

The invention provides a high-quality slider for a slide fastener provided with an automatic locking device, wherein the slider comprises a body, a pull, and the spring with the locking pawl, the spring is formed in an inverted U-shape comprising an upper and lower elements by cutting and bending a linear material having a same cross-sectional shape, a locking pawl is provided at a front end of the lower element, the body comprises a front and rear side attaching portions, a housing groove is provided at each attaching portion to house the spring so as to fix it to the upper element, a projection amount regulating portion of the locking pawl is provided on a wall of a pawl hole to elastically contact a base portion of a pawl element thereto, and a rear face of the upper element attached to the rear side attaching portion regulates an upward movement of the pawl element.

9 Claims, 11 Drawing Sheets

SLIDER FOR SLIDE FASTENER PROVIDED WITH AUTOMATIC LOCKING DEVICE

BACKGROUND OF THE INVENTION

1. Field of the Invention

The present invention relates to a slider for a slide fastener provided with an automatic locking device that can be used for both of a normal type of a slider and a hidden type of a slider provided with an automatic locking mechanism.

2. Description of the Related Art

A conventional slider 101 of a normal type provided with an automatic locking mechanism disclosed in U.S. Pat. No. 3,793,684, as shown in FIG. 16, comprises a body 103, a pull 104, and a spring 105 with a locking pawl, and the spring 105 with the locking pawl is formed by punching out a stainless steel plate into various shapes in a lateral width of the spring and then bending it so as to determine an attaching position with respect to the body 103. A slider 101 for a slide fastener provided with an automatic locking device has been known, in which a pintle 108 of a pull 104 is arranged between a front attaching portion 115 and a rear attaching portion 116 built on the body 103 in the formed spring 105 with the locking pawl, the spring 105 with the locking pawl is arranged between the front and rear attaching portions 115 and 116 from the above, and a locking pawl 127 at a front end is inserted into a pawl hole 120 defined on the body 103 so as to be fixed on the attaching portions 115 and 116.

Next, a conventional slider 201 of a hidden type provided with an automatic locking mechanism disclosed in Chinese Patent No. 246781, as shown in FIG. 17, comprises a body 203, a pull 204, a connection ring 207 and a spring 205 with a locking pawl, and the spring 205 with the locking pawl is formed by punching out a stainless steel plate into various shapes in a lateral width of the spring and then bending it so as to determine an attaching position with respect to the body 203. A slider 201 for a slide fastener provided with an automatic locking device has been known, in which the formed spring 205 with the locking pawl is inserted into an insertion hole of a connection ring 207 attached to a pull 204, the spring 205 with the locking pawl is maintained in that condition and arranged on a front attaching portion 215 and a rear attaching pole 216 build on the body 203, and the locking pawl 227 at a front end is inserted into a pawl hole 220 defined on the body 203 so as to be fixed on the attaching portion 215 and the attaching pole 216.

In each of the normal type and the hidden type of the slider 101 and 201 for the slide fastener provided with the automatic locking device as described above and shown in FIGS. 16 and 17, the spring 105 and 205 with the locking pawl does not have an even width in its length direction and the spring is punched out in various shapes in a lateral width. Therefore, it is difficult to easily manufacture the spring 105 and 205 with the locking pawl, dust due to punching out is generated, and a cost tends to be high because the material is used wastefully. Further, there is no portion on the body 103 and 203 to regulate projection amount in order to regulate a projection of the locking pawl 127 and 227 arranged on the spring 105 and 205 with the locking pawl into an element guide groove 119 and 219, which causes a problem that the locking mechanism is not stable and the locking function cannot be effectively exerted.

SUMMARY OF THE INVENTION

The present invention has been made taking the foregoing problems into consideration and a main object of a first aspect in the present invention is to provide a slider for a slide fastener provided with an automatic locking device, wherein the slider comprises a body, a pull, and a spring with a locking pawl, and the spring with the locking pawl is made of a linear material that can be easily processed and attached on the body, and the locking pawl provided at a front end of the spring with the locking pawl is regulated so as to project by a predetermined amount to an element guide groove. And the slider with a high-quality automatic locking device can be economically and simply manufactured.

An object of a second aspect of the invention, in addition to the object of the first aspect, is to provide a slider for a slide fastener provided with an automatic locking device, wherein the spring with the locking pawl can be made of a long linear material having an approximately same cross section in its length direction and the spring with the locking pawl can be economically and simply manufactured.

An object of third and fourth aspects of the invention, in addition to the object of the first aspect, is to provide a slider for a slide fastener provided with an automatic locking device, wherein the locking pawl of the spring with the locking pawl made of the long linear material can be projected by a predetermined amount to the element guide groove from a pawl hole defined on the body in a very stable manner.

An object of fifth and sixth aspects of the invention, in addition to the object of the first aspect, is to provide a slider for a slide fastener provided with an automatic locking device, wherein the spring with the locking pawl having an upper element and a lower element shaped approximately in a inverted U-shape is housed in an attaching portion provided on the body in a stable manner and the upper element is fixed so as to smoothly and simply operate the spring with the locking pawl.

An object of a seventh aspect of the invention, in addition to the object of the fifth aspect, is to provide a slider for a slide fastener provided with an automatic locking device, wherein an end of the upper element of the spring with the locking pawl is shaped to be bent downward and the spring with the locking pawl is attached to the attaching portion at a rear side provided on the body in a stable manner.

An object of an eighth aspect of the invention, in addition to the object of the first aspect, is to provide a slider for a slide fastener provided with an automatic locking device, wherein an upward movement amount of the spring with the locking pawl to be attached on the body is reduced and an excessive modification of the spring can be prevented by the attaching portion at the rear side of the body.

An object of a ninth aspect of the invention, in addition to the object of the first aspect, is to provide a slider for a slide fastener provided with an automatic locking device, wherein the attaching portion at a front side of the body can prevent an elastic operational portion of the spring with the locking pawl to be attached on the body from contacting other portions and being damaged, and can protect the elastic operational portion thereof.

An object of a tenth aspect of the invention, in addition to the object of the first aspect, is to provide a slider for a slide fastener provided with an automatic locking device, wherein a pawl element and a fastening element composing the spring are formed approximately in an inverted U-shape and the fastening element of the spring with the locking pawl is easily attached to the attaching portion provided at the front side of the body so as to exert a snapping force in a sable manner.

An object of an eleventh aspect of the invention, in addition to the object of the first aspect, is to provide a slider for a slide fastener provided with an automatic locking device, wherein the slider comprises a movement regulating portion for regulating an upward movement of the locking pawl.

An object of a twelfth aspect of the invention, in addition to the object of the fifth aspect, is to provide a slider for a slide fastener provided with an automatic locking device, wherein the lower element comprising a pawl element on an end thereof is housed in the housing groove so as to be movable without being nipped and held by the side walls.

In order to attain the above-described objects, the present invention preferably provides a slider for a slide fastener provided with an automatic locking device, wherein a slider comprises a body, a pull, and a spring with a locking pawl, and the spring with the locking pawl formed by a linear material is fixed to an attaching portion, a pawl element provided with a locking pawl at a front end thereof to elastically project to an element guide groove of the body is formed at one end of the spring with the locking pawl, and a projection amount regulating portion for regulating a projection amount of the locking pawl to the element guide groove by a predetermined amount is provided on the body.

Preferably, a movement regulating portion for regulating an upward movement or a swing of the locking pawl is provided on the body.

Preferably, the spring with the locking pawl is made of the linear material A with a rectangular, circle, or elliptic cross-sections formed to have approximately a same cross section in its length direction.

Preferably, the projection amount regulating portion for regulating the projection amount of the locking pawl to be provided on the body is formed to project or be elevated from the body toward the spring with the locking pawl so as to elastically contact the spring with the locking pawl.

Preferably, the projection amount regulating portion for regulating the projection amount of the locking pawl to be provided on the body is formed to project or be elevated more than a lower end of a pintle of the pull to an upward on a top of a wall of a pawl hole for projecting the locking pawl to the element guide groove.

Preferably, the spring with the locking pawl itself is formed approximately in an inverted U-shape comprising an upper element and a lower element opposed vertically, the attaching portion for attaching the spring with the locking pawl to be arranged on the body comprises a housing groove for housing the spring with the locking pawl, upper end portions of side walls on both sides are pressurized toward an inside of the housing grooves 11 and elastically deformed to incline, whereby the upper element is nipped and fixed by the side walls.

Preferably, the housing groove for housing the spring with the locking pawl has a shelf portion projecting toward an inside of the housing groove by a predetermined amount on each of the side walls of the housing groove, and when inclining the upper end portions of the side walls on both sides of the housing groove, the upper element of the spring with the locking pawl is mounted on the shelf portions.

Preferably, the attaching portion for attaching the spring with the locking pawl to be arranged at the body comprises a front side attaching portion provided at a front side of the body and a rear side attaching portion provided at a rear side of the body, each of the front side attaching portion and the rear side attaching portion is provided with the housing groove, respectively, an end of the upper element of the spring with the locking pawl is bent downward to form an insertion element, and a holding portion for inserting and holding the insertion element of the spring with the locking pawl therein is provided at the rear side attaching portion provided at the rear side of the body so as to fix the insertion element to the holding portion.

Preferably, the attaching portion for attaching the spring with the locking pawl to be mounted on the body comprises the front side attaching portion provided at the front side of the body and the rear side attaching portion provided at the rear side of the body, each of the front side attaching portion and the rear side attaching portion is provided with the housing groove for housing the spring with the locking pawl, respectively, and the rear side attaching portion is formed lower in a vertical direction of the body than the front side attaching portion.

Preferably, the attaching portion for attaching the spring with the locking pawl to be mounted on the body comprises the front side attaching portion provided at the front side of the body and the rear side attaching portion provided at the rear side of the body, each of the front side attaching portion and the rear side attaching portion is provided with the housing groove for housing the spring with the locking pawl, respectively, and the front side attaching portion is formed longer in a longitudinal direction of the body than the rear side attaching portion.

Preferably, the pawl element and a fastening element are opposed at front and rear sides of the spring with the locking pawl, which are entirely formed approximately in an inverted U-shape, the housing groove is provided at an upper side of the front side attaching portion at the front side of the body, a vertical hole is defined in the housing groove in a vertical direction for inserting the fastening element therein, a fastening portion inclined inside of the vertical hole is provided in the vertical hole, a front end of the fastening element of the spring with the locking pawl is fixed to the fastening portion by bending it or the like, and the movement regulating portion is formed by bending an upper edge of the housing groove inward for regulating the movement of the spring with the locking pawl.

The present invention exerts effects that the spring with the locking pawl can be made of a linear material that can be easily processed, and the locking pawl provided at the front end of the spring with the locking pawl is positively prevented from projecting to the element guide groove beyond necessity so as to exert a locking function smoothly and appropriately. In addition, the spring with the locking pawl is prevented from moving and swinging upward beyond necessity so as to easily carry out a pulling operation of the pull. Thus, it is possible to economically and easily manufacture the high-quality slider with the automatic locking device.

In addition, a waste material is not generated and the spring with the locking pawl can be manufactured very economically because the continuous long linear material with a rectangular, a circle, or an elliptic cross-section is cut into a predetermined length and then, the spring with the locking pawl is formed only by carrying out a bending processing.

In addition, the projection amount regulating portion, which regulates the projection of the locking pawl to a predetermined amount, can be provided close to the pawl hole, the spring with the locking pawl always elastically contacts the projection amount regulating portion, and the projection amount of the locking pawl to the element guide groove can be secured stably.

In addition, the lower element of the spring with the locking pawl can freely snap and a snapping force can be smoothly exerted since only the upper element of the spring with the locking pawl formed approximately in the inverted U-shape is nip and fixed in a stable manner.

In addition, the end portion of the upper element of the spring with the locking pawl can be attached at the rear side of the body in a stable manner and the spring with the locking pawl can be positioned with respect to the body in a longitudinal direction.

In addition, an upward movement of the spring with the locking pawl before it is regulated by the movement regulating portion can be decreased and the movement regulating portion can be arranged in an allowable range for elastical deformation so as to prevent an excessive deformation of the spring with the locking pawl.

In addition, the front side attaching portion can house a large part of an operational portion of a snapping force in the spring with the locking pawl so as to prevent a deformation and damage when another object contacts this operational portion, and a stable snapping force can be secured for a long period of time.

In addition, one end of the spring with the locking pawl formed in the inverted U-shape can be fixed at the front side of the body in a stable manner, a snapping function can be smoothly exerted, and the upward movement can be easily regulated.

DESCRIPTION OF THE PREFERRED EMBODIMENTS

Figure 1:
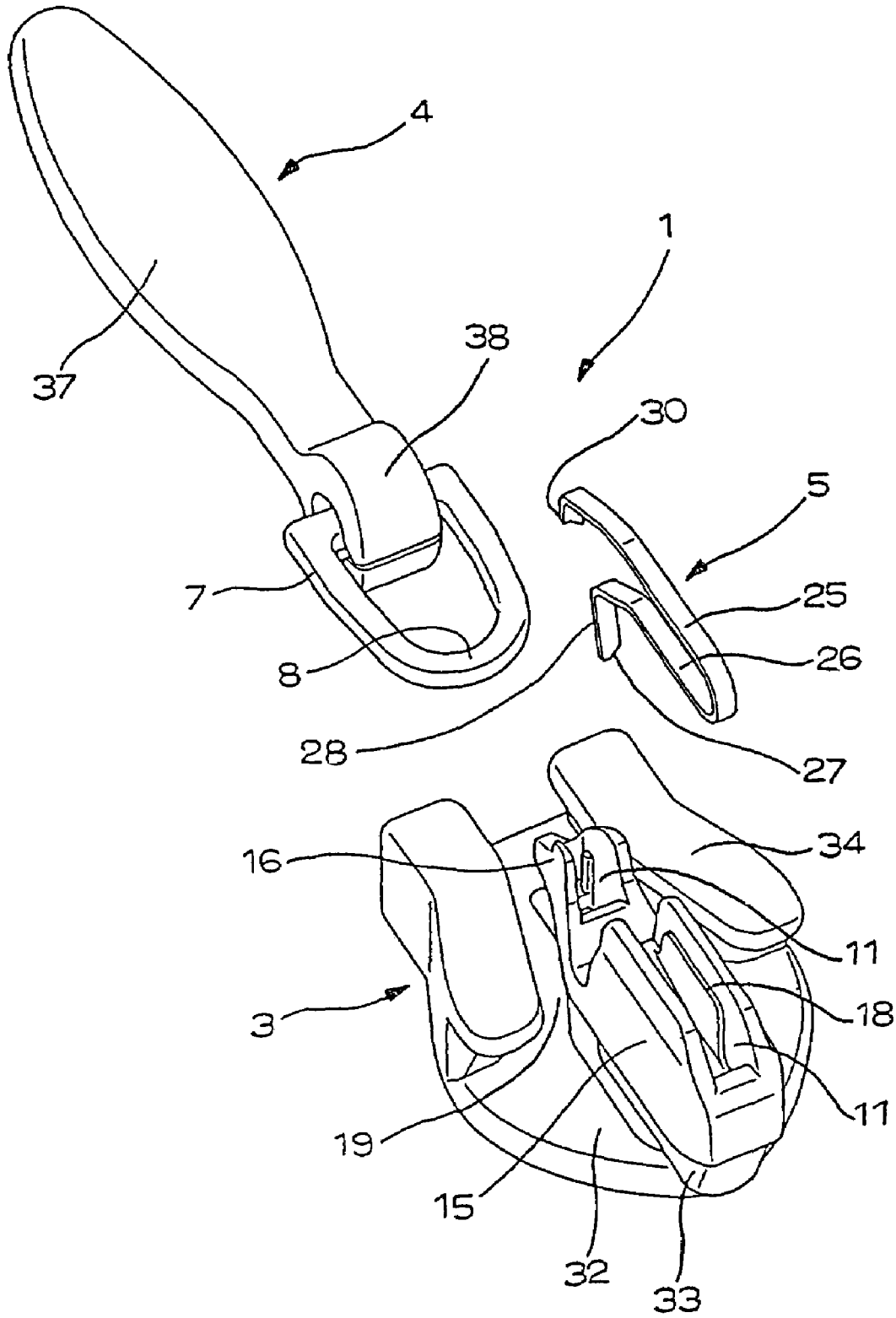
FIG. 1 is an exploded perspective view of a slider for a slide fastener provided with an automatic locking device.

A slider for a slide fastener provided with an automatic locking device according to the present invention is a slider 1 provided with a locking mechanism. The slider is configured by a body 3, a pull 4, and a spring 5 with the locking pawl; the body 3 and the pull 4 are made by molding a metal such as a zinc alloy and an aluminum base alloy by die-cast molding means; and the spring 5 with the locking pawl is formed by cutting a continuous long liner material made of a stainless steel or the like into a predetermined length in its length direction and then, bending it.

In the body 3 of a slider 1 of a normal type, an upper wing plate 31 and a lower wing plate 32 are connected by a guide post 33; flanges 34 are formed to be bent at both sides of the upper wing plate 31 to form element guide grooves 19; a front side attaching portion 15 and a rear side attaching portion 16 are built at front and rear sides of the upper wing plate 31 so as to form an attaching portion 10 for attaching the spring 5 with the locking pawl thereto; this attaching portion 10 is provided with a housing groove 11 capable of housing the spring with the locking pawl 5 therein; and an U-shaped spring with the locking pawl 5 is nipped and fixed between side walls 17 of the housing groove 11 on both sides by pressurizing upper end portions of the side walls 17 toward an inside of the housing groove 11 and elastically deforming them so as to incline.

In the body 3 of a slider 1 of a hidden type, the guide post 33 is built at a front end of the lower wing plate 32; the upper wing plate 31 is extended on a center of this guide post 33 to a rear side thereof; the flanges 34 formed in an inverted L-shape are built on both sides of the lower wing plate 32 so as to define the element guide grooves 19; the front side attaching portion 15 as the attaching portion 10 to attach the spring with the locking pawl 5 is provided at an upper side of the guide post 33; and the rear side attaching portion 16 as the attaching portion 10 is built at a rear end side of the upper wing plate 31. On the front side attaching portion 15 and the rear side attaching portion 16, the housing grooves 11 capable of housing the spring 5 with the locking pawl are provided; and the spring 5 with the locking pawl is nipped and fixed between the side walls 17 on both sides by pressurizing the upper end portions of side walls 17 on both sides of the housing grooves 11 toward the inside of the housing groove 11 and elastically deforming it to be inclined.

The hidden type of the slider 1 will be described in detail below. In the spring 5 with the locking pawl, a locking pawl 27 is formed at one end thereof by cutting a continuous linear material A with a rectangular cross-section into each predetermined length in its length direction; and this cut linear material A is bent by applying a bending operation thereto to form an U-shape. The spring 5 with the locking pawl comprises an upper element 25 and a lower element 26 in order to dispose the spring with the locking pawl 5 in a laid state in a lateral direction on the attaching portion 10; a pawl element 28 bent downward is formed at one end of the lower element 26; a locking pawl 27 is formed at its front end; and one end of the upper element 25 is bent downward to form an insertion element 30. The manufactured spring with the locking pawl 5 has a portion of which cross-section is gradually small toward its cut end, namely, the locking pawl 27 and the insertion element 30, however, a cross-section thereof is approximately same in its length direction. In other words, the cross-section thereof is substantially equal with the cross-section of the linear material A before cutting.

The attaching portion 10 is formed in such a manner that the front side attaching portion 15 is formed by recessing the housing groove 11 as a gap in a center longitudinal direction upward of the guide post 33, a shelf portion 18 projecting toward the inside of the housing groove 11 is provided on each of the side walls 17 of the housing groove 11 so that it comes between the upper element 25 and the lower element 26 and loads the upper element 25 thereon when the side walls 17 on both sides are inclined. On the rear side attaching portion 16, a pawl hole 20 for inserting a pawl element 28 of the spring with the locking pawl 5 is defined, and a front wall of this pawl hole 20 is projected upward to form a projection amount regulating portion 12 for regulating a projection amount of the locking pawl 27. On the rear side of the pawl hole 20, a holding portion 23 into which an insertion element 30 of the spring with the locking pawl 5 is inserted for being held and fixed is formed, the holding portion 23 is formed of an insertion portion 24 recessed with a width of the spring 5 with the locking pawl, and a projection 35 arranged between the insertion portion 24 and the pawl hole 20 to be projected toward the inside of the housing groove 11.

The slider 1 is assembled in such a manner that a pintle 8 of a connection ring 7 that is connected to the pull 4 is arranged at a recessed portion 39 between the front side attaching portion 15 and the rear side attaching portion 16 of the body 3, the spring 5 with the locking pawl is mounted from above to insert the pawl element 28 into the pawl hole 20, a front end of the locking pawl 27 is projected to an element guide groove 19, a curved portion of the spring 5 with the locking pawl is housed in the housing groove 11 of the front side attaching portion 15, the insertion element 30 at a front end of the upper element 25 is inserted in the insertion portion 24 provided in the housing groove 11 of the rear side attaching portion 16, the side walls 17 on both sides in the respective housing grooves 11 are pressurized toward the inside of the housing groove 11 so as to be elastically deformed and inclined, and the upper element 25 is nipped and fixed between the side walls 17 on both sides when the upper element 25 is mounted on the shelf portion 18 at the front side attaching portion 15, the self portion 18 being displaced so as to be positioned at a lower side of the upper element 25 of the spring 5.

In the assembled slider 1, the lower element 26 of the spring 5 with the locking pawl is lifted up by the pintle 8 of the connection ring 7 when the pull 4 is pulled, a bending portion of the pawl element 28 abuts against a lower side of the upper element 25 of the fixed spring 5 with the locking pawl, namely, a rear side of the upper element 25 of the fixed spring 5 with the locking pawl, which forms a movement regulating portion 13 for regulating an upward movement of the locking pawl 27. In addition, if the pull 4 is released to be free, the pawl element 28 snaps downward together with the lower element 26 of the spring 5 with the locking pawl, the pawl element 28 elastically contacts a projection amount regulating portion 12 that is projected and is raised on a top of a wall of a front side of the pawl hole 20 so that the locking pawl 27 is projected to the element guide groove 19 by a predetermined amount without projecting it beyond necessity, and the locking pawl 27 is inserted between fastener elements to automatically lock a sliding of the slider 1.

First Embodiment

The slider for the slide fastener provided with the automatic locking device according to a first embodiment of the invention shown in FIGS. 1 to 9 is the hidden type of the slider 1. In this slider 1, the guide post 33 is built at the front end of the lower wing plate 32 on the body 3, the upper wing plate 31, of which a width becomes gradually narrow from a center of an upper face of this guide post 33 toward a rear side thereof, is extended, and a flange 34 of an inverted L-shape made of a vertical portion vertically rising from the lower wing plate 32 and a horizontal portion extended from a front end of the vertical portion in parallel with the lower wing plate 32 is built on both sides of the lower wing plate 32 to provide an element guide groove 19 for guiding a fastener element between the flange 34 and the guide post 33. The front side attaching portion 15 as the attaching portion 10 for attaching the spring 5 with the locking pawl is built at the upper side of the guide post 33, the rear side attaching portion 16 as the attaching portion 10 for attaching the spring 5 with the locking pawl is built at the rear side of the upper wing plate 31 with a gap between itself and the front end attaching portion 15, and a recessed portion 39 is provided at this gap portion so as to mount the pintle 8 of the pull 4 on the gap portion. Lengths of the front side attaching portion 15 and the rear side attaching portion 16 are different in a longitudinal direction of the body 3. In other words, the rear side attaching portion 16 is shorter than the front side attaching portion 15 and the front side attaching portion 15 is longer than the rear side attaching portion 16. In addition, heights of the front side attaching portion 15 and the rear side attaching portion 16 are different in a vertical direction of the body 3. In other words, the front side attaching portion 15 is higher than the rear side attaching portion 16 and the rear side attaching portion 16 is lower than the front side attaching portion 15.

Figure 7:
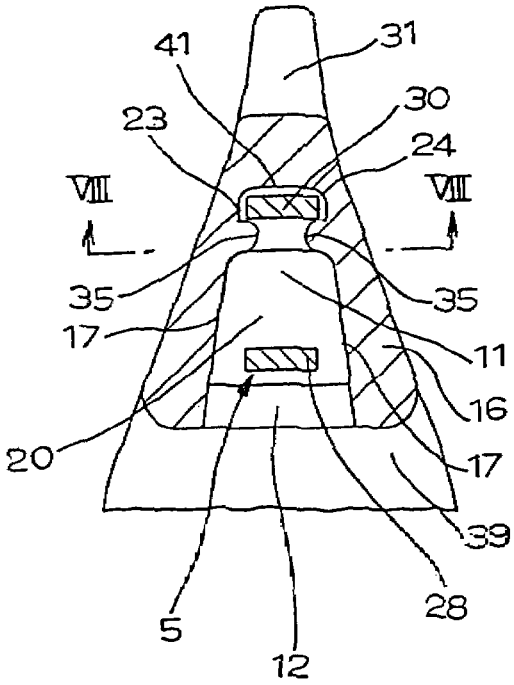
FIG. 7 is a cross-sectional view showing a condition that the spring with the locking pawl is housed in a housing groove disposed at a rear attaching portion.

In the front side attaching portion 15, the housing groove 11 as a gap for housing the spring 5 with the locking pawl is recessed on an upper face in a central longitudinal direction, a bottom portion of this housing groove 11 is recessed in a curved shape, and on each of the side walls 17 on each side, a shelf portion 18 projecting in a stepped manner toward the inside of the housing groove 11 is provided. This shelf portion 18 is formed so as to be positioned outside of a side edge of the spring 5 with the locking pawl without mounting the spring 5 with the locking pawl housed in the housing groove 11 before the side walls 17 are elastically deformed so as to incline. In addition, on the rear side attaching portion 16, the housing groove 11 shaped in a gap-shape is recessed in the central longitudinal direction, a pawl hole 20, in which the pawl element 28 of the spring 5 with the locking pawl is inserted, communicating with the element guide groove 19 is provided at the front end of the housing groove 11, and the locking pawl 27 provided at a front end of the pawl element 28 is projected to the element guide groove 19. By forming a front wall of the pawl hole 20 to project and rise upward, the projection amount regulating portion 12 for regulating the projection amount of the locking pawl 27 of the spring 5 with the locking pawl to the element guide groove 19 by a predetermined amount is provided and a bent portion on an upper side of the pawl element 29 of the spring 5 with the locking pawl elastically contacts the projection amount regulating portion 12. In addition, as shown in FIG. 7, at the side wall 17 of the housing groove 11 at the rear side of the pawl hole 20, a projection 35 projecting toward the inside of the housing groove 11 is provided, and the insertion portion 24 capable of inserting the insertion element 30 of the spring 5 with the locking pawl is provided between this projection 35 and a rear wall 41 of the housing groove 11 so as to form the holding portion 23 capable of holding the insertion element 30 by the projection 35 and the rear wall 41. On the housing groove 11 of the rear side attaching portion 16, three directions are encircled by right and left side walls 17 on both sides and the rear wall 41 so as to prevent other elements from contacting the pawl element 28 to be inserted from an outside of the rear side attaching portion 16 into the pawl hole 20. The projection amount regulating portion 12 and the holding portion 23 are integrally formed with the rear side attaching portion 16.

Figure 2:
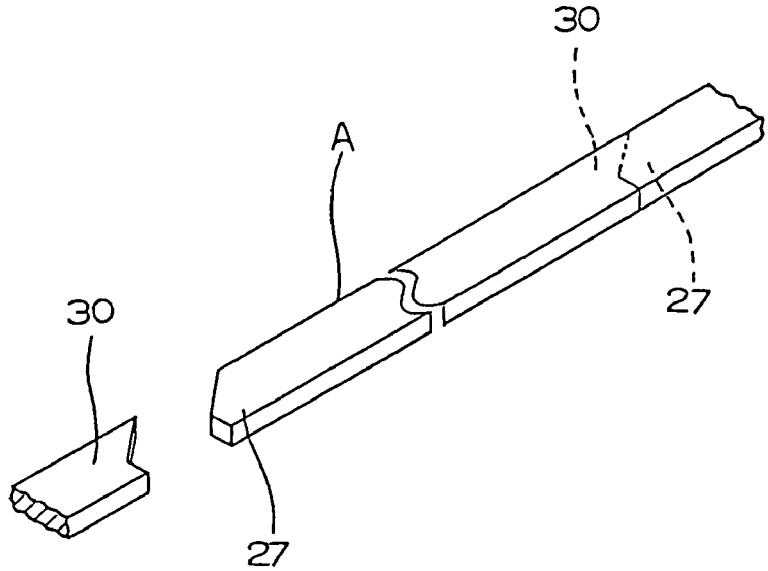
FIG. 2 is an explanatory view explaining a means for manufacturing a spring with a locking pawl from a linear material.
Figure 3:
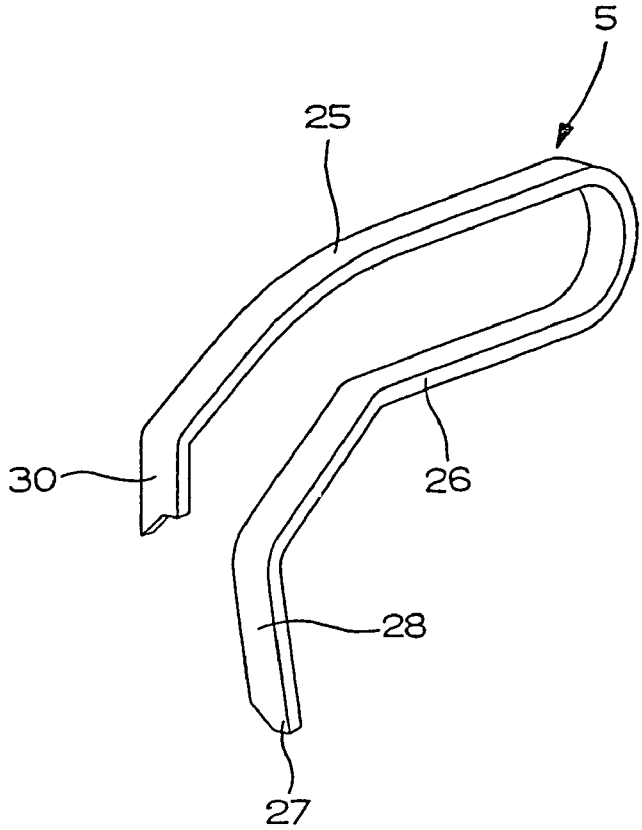
FIG. 3 is a perspective view of the spring with the locking pawl manufactured from the linear material.
Figure 4:
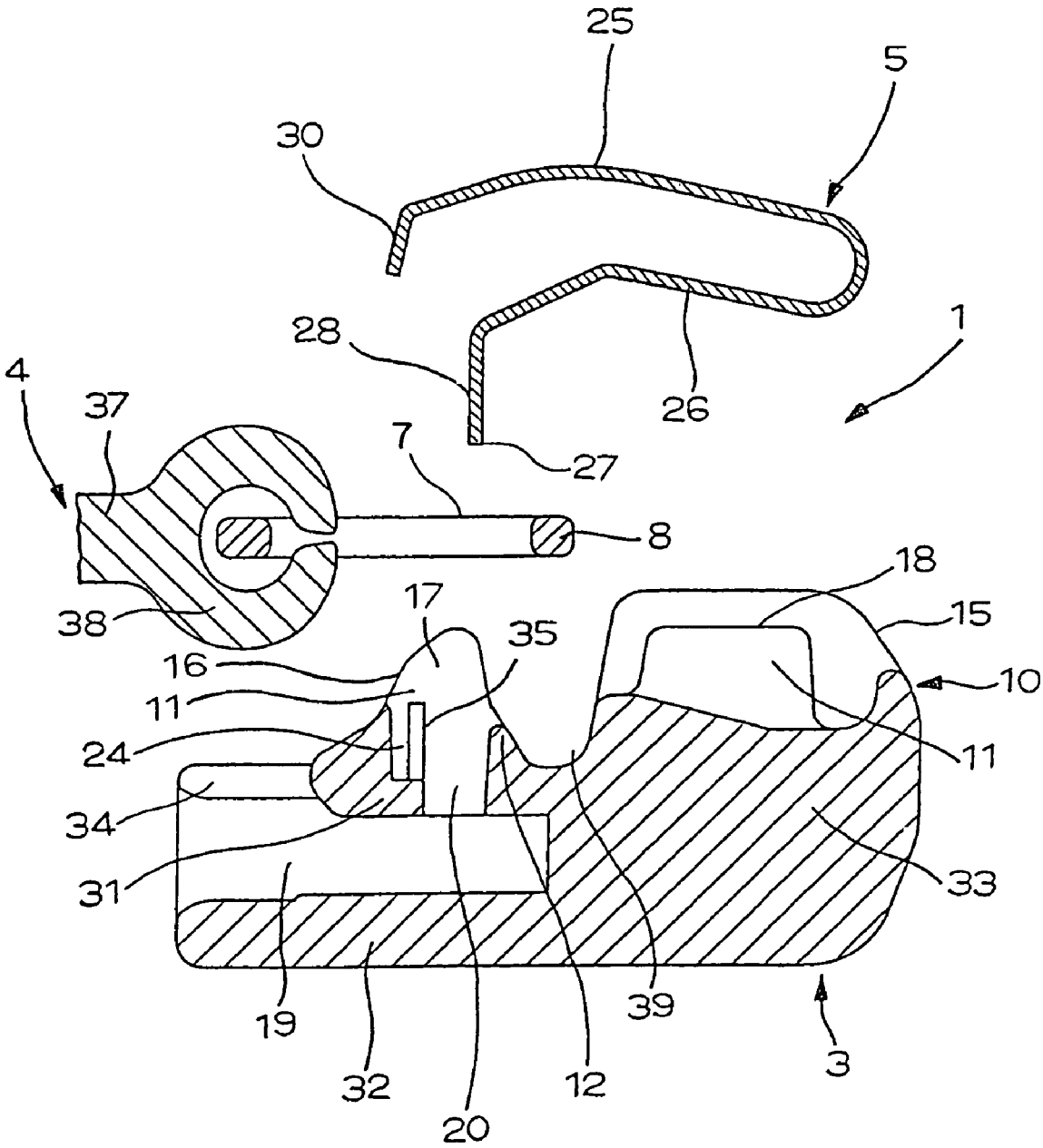
FIG. 4 is an exploded cross-sectional view of the slider for the slide fastener provided with the automatic locking device.

As shown in FIG. 2, the spring 5 with the locking pawl is formed by cutting the linear material A with a rectangular cross-section that is continued in a length direction for each predetermined length so as to form the locking pawl 27 and then, bending this linear material A. As shown in FIG. 3, the spring 5 with the locking pawl comprises a curved portion bent approximately in a inverted U-shape, the upper element 25 and the lower element 26 to be connected through the curved portion, wherein the insertion element 30 is formed by bending the front end of the upper element 25 downward, the pawl element 28 is formed by bending the lower element 26 downward, and the locking pawl 27 is formed at a front end thereof. The upper element 25, the lower element 26 and the curved portion have a same cross-sectional shape having a same width and thickness. This locking pawl 27 is formed by cuing the linear material A in such a manner that the cross-section is made gradually small toward its cutting end. On the other hand, a cut end portion of the linear material A on a side opposite to an cut end portion provided with the locking pawl 27 has a remaining shape formed after the locking pawl 27 is cut off, which serves as the insertion element 30 of the spring 5 with the locking pawl. Therefore, the linear material A is completely used in order to manufacture the spring 5 with the locking pawl and no portion is wasted. In the meantime, the linear material A may have a circle or an elliptic cross-section and a cross-section of the locking pawl 27 may be equal with other portions of the spring 5 with the locking pawl.

As shown in FIG. 1, the pull 4 is formed from a grip body 37 of a rectangular shape that is provided with a connection portion 38 shaped in a C-shape at its front end, and a damper of an arietiform circle shape, namely, a connection ring 7 is rotatably provide at the connection portion 38. In the meantime, the pull 4 may be formed in a short strip shape with a pintle 8 at its front end without the clamper.

The slider 1 is assembled in such a manner that the pintle 8 of the connection ring 7 that is attached rotatably at the front end of the pull 4 is arranged inside of the recessed portion 39 provided between the front side attaching portion 15 and the rear side attaching portion 16 formed on the body 3, the spring 5 with the locking pawl is mounted so as to cover the pintle 8 from above to insert the pawl element 28 into the pawl hole 20, the front end of the locking pawl 27 is projected to the element guide groove 19, and the curved portion of the spring 5 with the locking pawl is housed in the housing groove 11 of the front side attaching portion 15. Since the long front side attaching portion 15 houses the curved portion 29 and a larger part of the lower element 26 extending to the curved portion 29 in its housing groove 11, it is possible to certainly prevent the curved portion 29 of the spring 5 with the locking pawl as the operational portion that is elastically deformed and the lower element 26 from contacting other elements at the outside. In this case, as shown in FIG. 5, the upper and lower elements 25 and 26 of the spring 5 with the locking pawl are arranged so that their both side edges are located inside of the shelf portion 18 in the housing groove 11, and as shown in FIG. 7, the insertion element 30 at the front end of the upper element 25 is inserted in the insertion portion 24 that is provided on the housing groove 11 of the rear side attaching portion 16.

Figure 6:
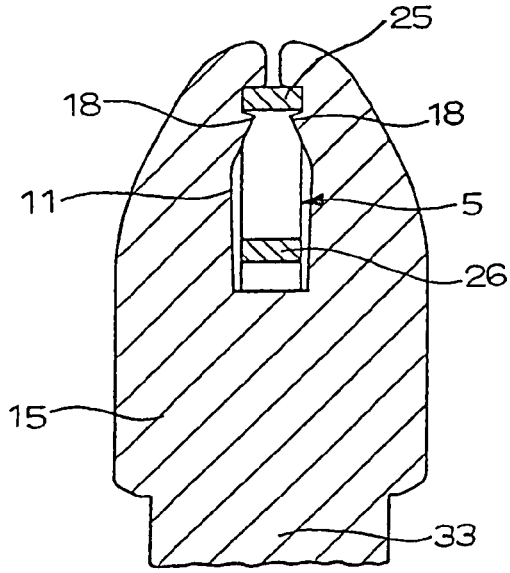
FIG. 6 is a cross-sectional view showing a condition that the spring with the locking pawl is fixed to the housing groove disposed at the front attaching portion.
Figure 8:
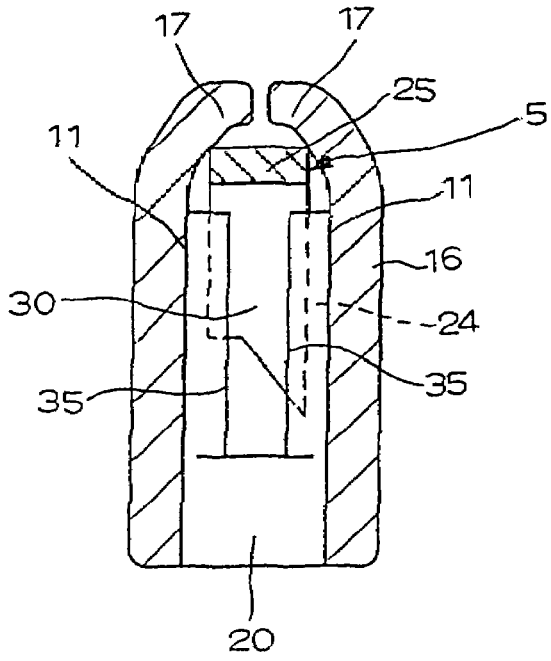
FIG. 8 is a cross-sectional view taken along a line VIII-VIII in FIG. 7.

Thereafter, as shown in FIGS. 6 and 8, the upper end portions of the side walls 17 on both sides in each housing groove 11 are pressurized toward the inside of the housing groove 11 and the upper end portions of the side walls 17 are elastically modified to be inclined so as to nip side edges of the upper element 25 from right and left.

Figure 5:
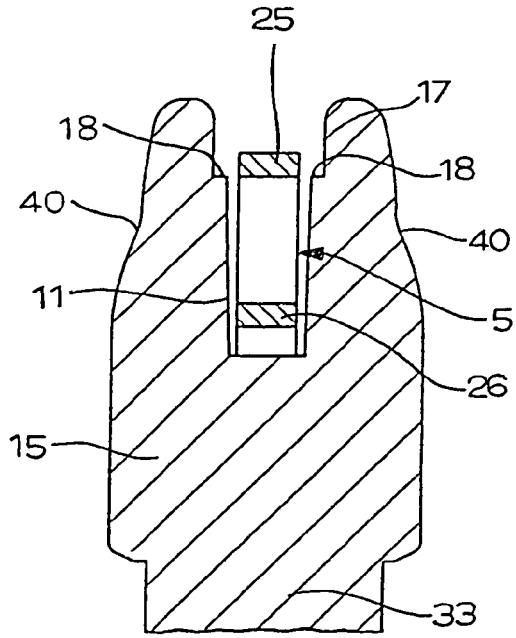
FIG. 5 is a cross-sectional view showing a condition that the spring with the locking pawl is housed in a housing groove disposed at a front attaching portion.

In front side attaching portion 15, the upper end portion of the side wall 17 is inclined to the inside of the housing groove 11 based on a bent reference position 40 shown in FIG. 5 and the shelf portion 18 moves to the inside of the housing groove 11 so as to be put between the upper element 25 and the lower element 26 of the spring 5 with the locking pawl beyond the side edge of the upper element 25. As a result, the shelf portion 18 is located under the upper element 25 so that the upper element 25 is mounted on the shelf portion 18 and a front and rear faces of the upper element 25 are nipped from above and below by the upper end portion of the side wall 17 and the shelf portion 18.

On the other hand, the lower element 26 of the spring 5 with the locking pawl is formed to freely move without being nipped between the side wall 17 and the shelf portion 18.

Figure 9:
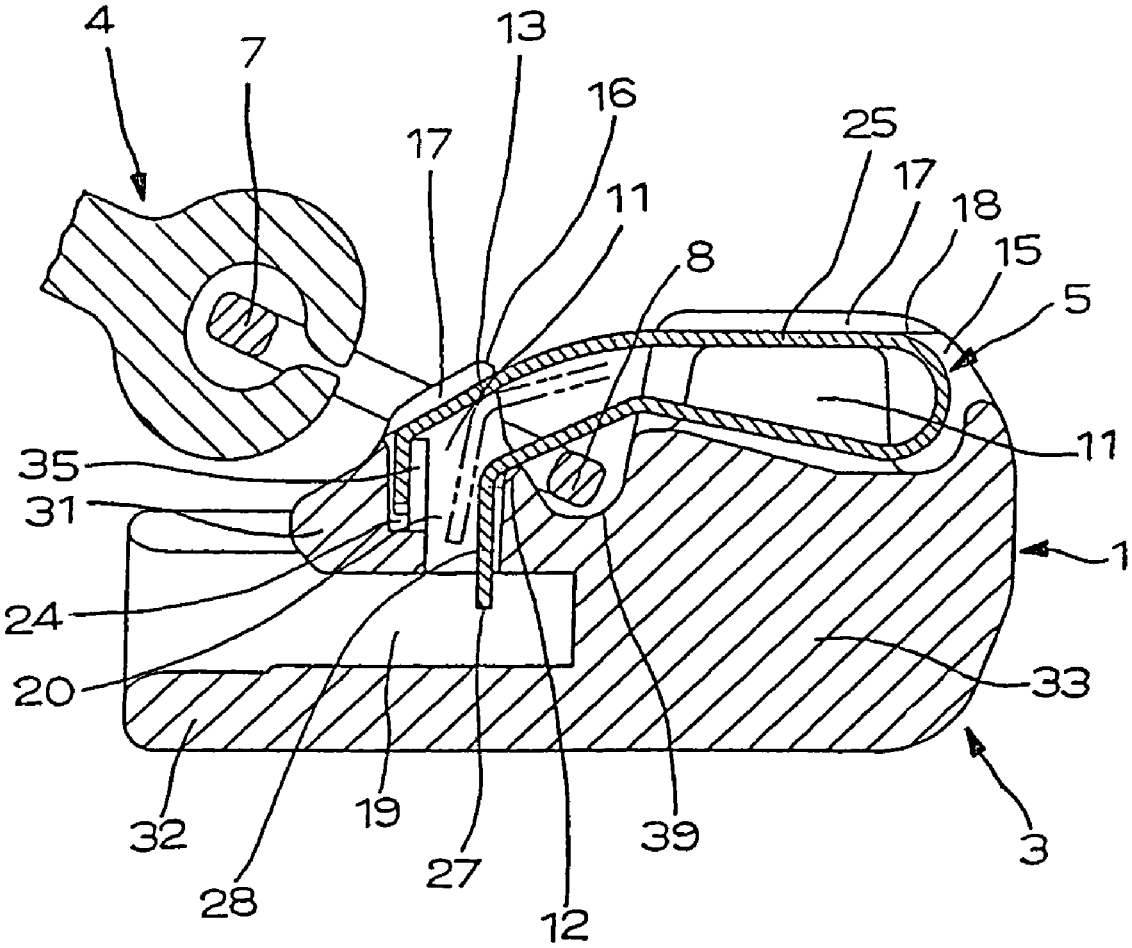
FIG. 9 is a cross-sectional view of the slider for the slide fastener provided with the automatic locking device.

In the assembled slider 1, if the pull 4 is pulled, as shown in FIG. 9, the pawl element 28 is pulled up, and the bent portion abuts against the rear face of the upper element 25 of the spring 5 with the locking pawl fixed to the side wall 17 of the rear side attaching portion 16 as shown by a chained line, which prevents any further pulling operation. Accordingly, this portion prevents and regulates the upward movement of the locking pawl 27 of the spring 5 with the locking pawl so as to configure the movement regulating portion 13. Since a portion fixed to the rear side attaching portion 16 in the upper element 25 is made into the movement regulating portion 13, the lower element 26 is pulled up with a strong force. Even if the pawl element 28 or the lower element 26 strikes the upper element 25, the upper element 25 is not deformed since it is supported by the rear side attaching portion 16 and a stable movement regulating function can be exerted. In addition, since the rear side attaching portion 16 is formed so that a height in a vertical direction of the body 3 is lower than that of the front side attaching portion 15, the upper element 25 is inclined downward from the front side attaching portion 15 to the rear side attaching portion 16 and a position where the upper element 25 is fixed on the rear side attaching portion 16 is lower than a position where the upper element 25 is fixed on the front side attaching portion 15. With this configuration, a moving distance till the bent portion of the pawl element 28 abuts against the rear face of the upper element 25 can be made shorter and a limit position of an upward movement of the locking pawl 27 can be arranged within an allowable range of an elastic modification of the spring 5 with the locking pawl to exert a stable snapping force for a long period of time. If the pull 4 is released, the spring 5 with the locking pawl moves downward, and as shown in FIG. 9, the lower element 26 elastically contacts the projection amount regulating portion 12 projected on the body 3 and any more projection of the locking pawl 27 to the element guide groove 19 is regulated. In the meantime, a position of the projection amount regulating portion 12 is not limited to the present embodiment and it may be provided at a bottom of the housing groove 11 of the front side attaching portion 15.

Second Embodiment

Figure 10:
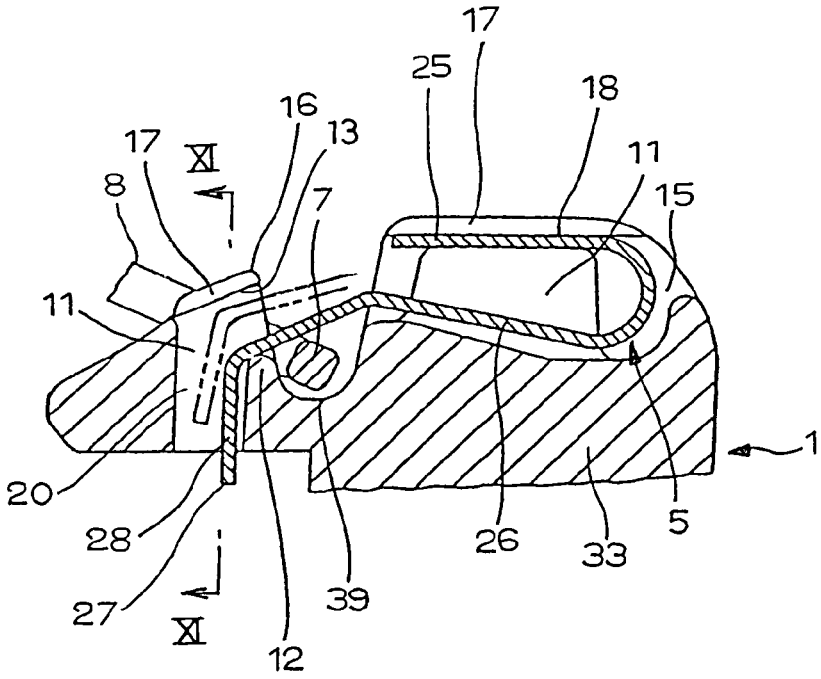
FIG. 10 is a partial cross-sectional view showing a movement regulating portion according to a second embodiment.
Figure 11:
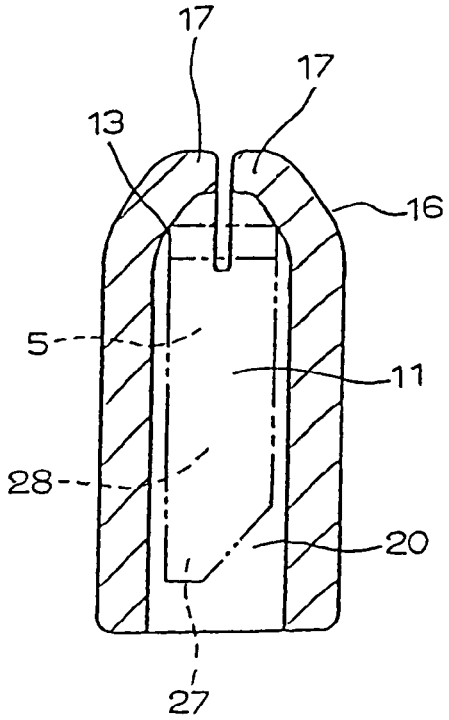
FIG. 11 is a cross-sectional view taken along a line XI-XI in FIG. 10.

The slide fastener provided with the automatic locking device according to a second embodiment of the invention shown in FIG. 10 is the slider 1 of the hidden type. On the body 3, the front side attaching portion 15 and the rear side attaching portion 16 are built, the front side attaching portion 15 is provided with the housing groove 11 likewise the above-described first embodiment, a bottom portion of the housing groove 11 is recessed in a curved manner, and the side wall 17 on each side is provided with the shelf portions 18 projecting toward the inside of the housing groove 11. An appearance of the rear side attaching portion 16 is equal with a former example, however, a wall face of a rear side of the pawl hole 20 is formed as a vertical face, the projection amount regulating portion 12 is formed by projecting and raising a front wall of the pawl hole 20 to an upper side, and further, as shown in FIG. 11, by bending the upper end portions of the side walls 17 on both sides of the housing groove 11 toward the inside, the movement regulating portion 13 for regulating the upward movement of the locking pawl 27 of the spring 5 with the locking pawl is formed. The rear side attaching portion 16 is formed so that the height rising from the body 3 is lower than that of the front side attaching portion 15 and if the lower element 26 is pulled up by the pintle 8 of the pull 4, the bent portion of the pawl element 28 abuts against the movement regulating portion 13 so as to regulate the upward movement of the locking pawl 27. The recessed portion 39 is formed between the front side attaching portion 15 and the rear side attaching portion 16 so that the pintle 8 of the pull 4 is mounted therein.

In the spring 5 with the locking pawl, the upper element 25 formed approximately in the inverted U-shape according to the former example is made shorter to be arranged in the housing groove 11 of the front side attaching portion 15. On the other hand, a front end side of the lower element 26 is bent so as to form the pawl element 28, and the locking pawl 27 is provided at its front end likewise the former example. The slider 1 of the hidden type comprises the spring 5 with the locking pawl, wherein the side walls 17 on both sides of the housing groove 11 at the front side attaching portion 15 are pressurized toward the inside of the housing groove 11 so as to elastically deform and incline the side walls 17 one both sides. As a result, the upper element 25 is nipped and fixed between the side walls 17 on both sides. Further, in accordance with an inclination of the side walls 17, the shelf portion 18 is moved so as to be positioned under the upper element 25, the upper element 25 is mounted on the shelf portion 18, the pawl element 28 at the front end side of the lower element 26 is inserted in the pawl hole 20, and the locking pawl 27 is projected to the element guide groove 19, an the bent portion of the pawl element 28 elastically contacts the projection amount regulating portion 12.

Third Embodiment

Figure 12:
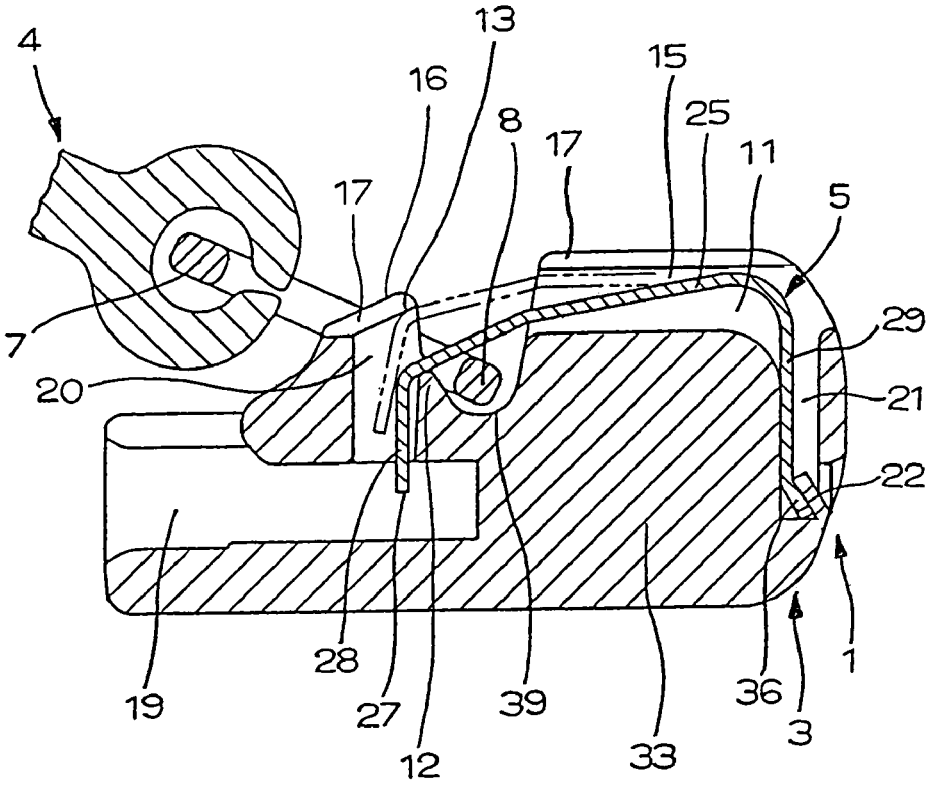
FIG. 12 is a cross-sectional view of a slider for a slide fastener provided with an automatic locking device according to a third embodiment.
Figure 13:
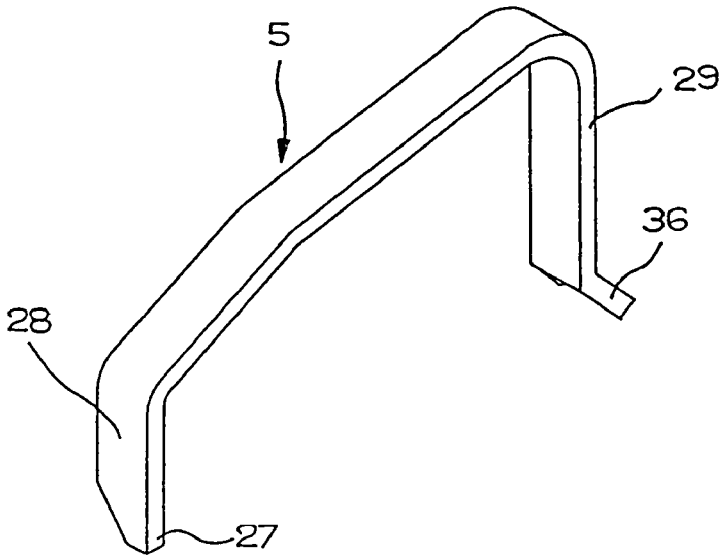
FIG. 13 is a perspective view of a spring with a locking pawl of the slider.

The slide fastener provided with the automatic locking device according to a third embodiment of the invention shown in FIGS. 12 and 13 is the slider of the hidden type. In this slider 1, the bottom portion of the housing groove 11 at the front side attaching portion 15 to be provided on the body 3 is formed approximately horizontally, the vertical hole 21 elongated to the inside of the guide post 33 is provided at a front end side of the housing groove 11, the rear side attaching portion 16 is provided with the pawl hole 20 communicating with the element guide groove 19 in a vertical direction, the recessed portion 39 is defined between the front side attaching portion 15 and the rear side attaching portion 16, and the top of the wall at the front side of the pawl hole 20 is projected and is raised to form the projection amount regulating portion 12. The spring 5 with the locking pawl is entirely formed approximately in a inverted U-shape with the pawl element 28 and the fastening element 29 opposed each other in front and rear sides of the spring 5 with the locking pawl, the lower end of the fastening element 29 is inclined outward to form a fixed portion 36, and the locking pawl 27 is provided at the front end of the pawl element 28.

As to an arrangement of the spring 5 with the locking pawl, the fastening element 29 of the spring 5 with the locking pawl is inserted in the vertical hole 21, a portion of a front face of the guide post 33 is pressed from its front side at a lower end of the vertical hole 21 so as to be inclined to an inside of the vertical hole 21, and a fastening portion 22 to fasten the fixed portion 36 therewith is formed. By pressurizing the upper end portions of the side walls 17 on both sides of the housing grooves 11 toward the inside of the housing grooves 11 and elastically deforming these upper end portions to be bent, an escape of the spring 5 with the locking pawl is prevented. The front side attaching portion 15 is formed longer in the longitudinal direction of the body 3 than the rear side attaching portion 16, and a large part of the spring 5 with the locking pawl on a side of the fastening element 29 is housed in the housing groove 11. In addition, by elastically deforming the upper end portions of the side walls 17 on both sides of the housing groove 11 at the rear side attaching portion 16 to be bent toward the inside of the housing groove 11, an escape of the spring 5 with the locking pawl is prevented. Further, the locking pawl 27 of the spring 5 with the locking pawl abuts against the side walls 17 on both sides when it moves upward. Thus, the slider 1 of the hidden type is provided with the movement regulating portion 13 for regulating any more movement.

Fourth Embodiment

Figure 14:
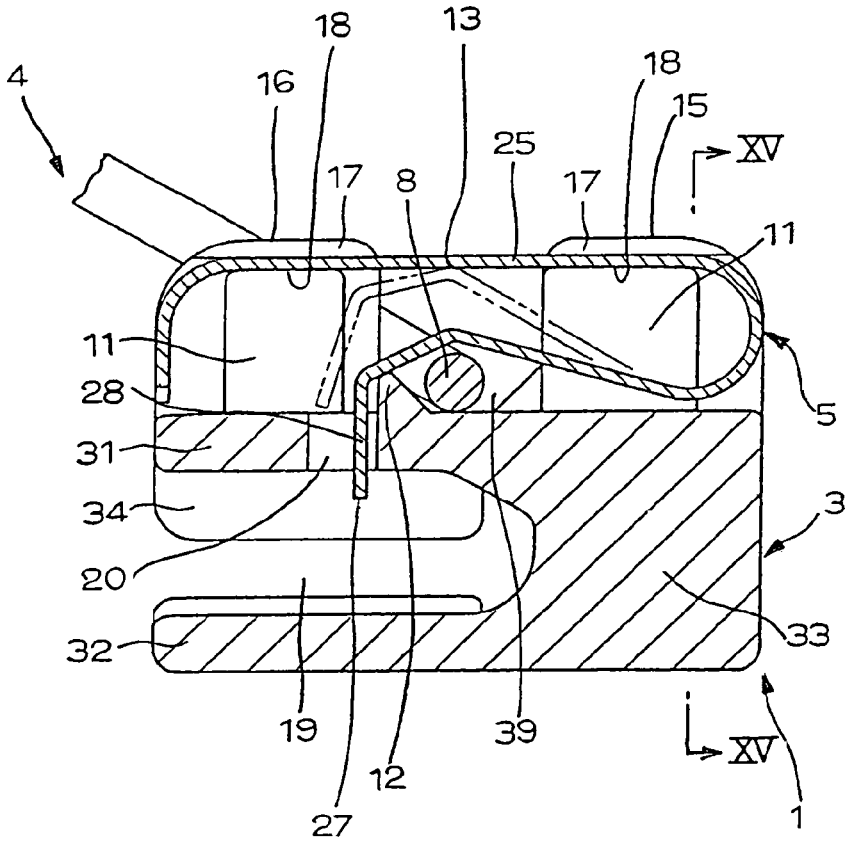
FIG. 14 is a cross-sectional view of a slider for a slide fastener provided with an automatic locking device according to a fourth embodiment.
Figure 15:
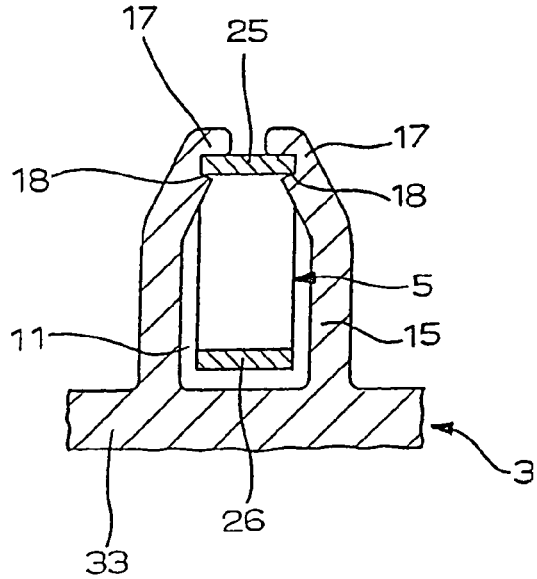
FIG. 15 is a cross-sectional view taken along a line XV-XV in FIG. 14.
Figure 16:
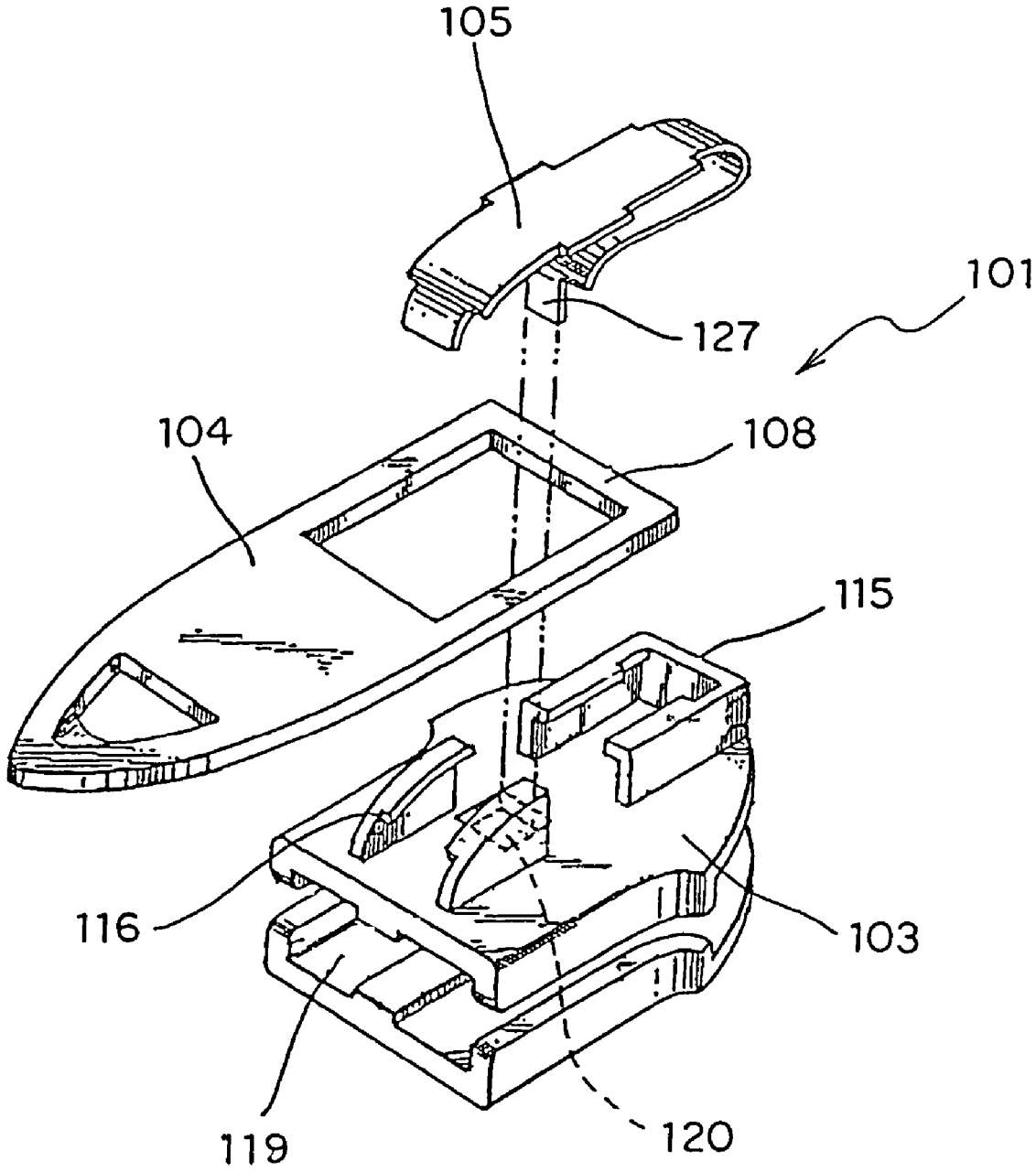
FIG. 16 PRIOR ART
FIG. 16 is an exploded perspective view of a known slider for a slide fastener provided with an automatic locking device.
Figure 17:
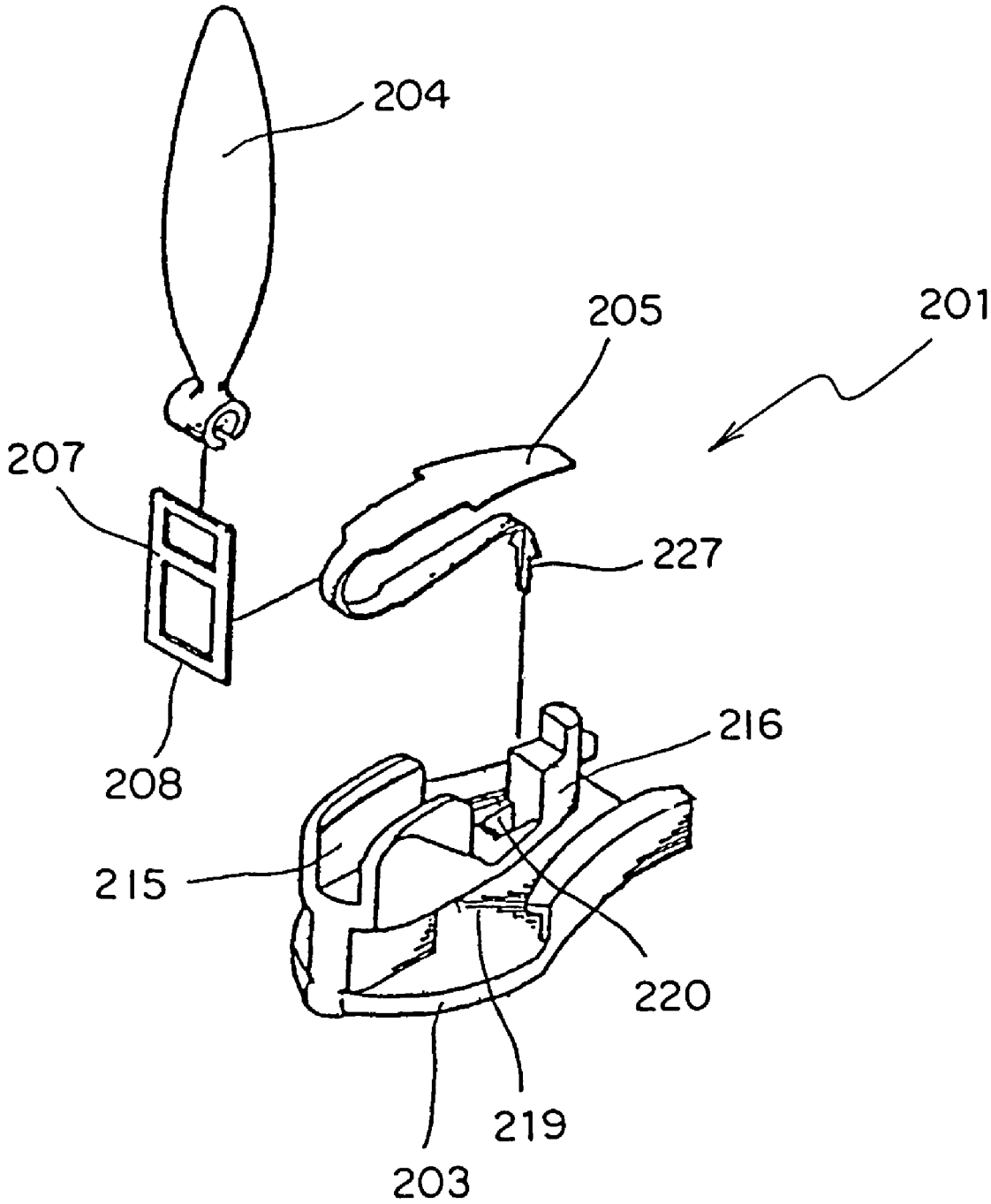
FIG. 17 PRIOR ART
FIG. 17 is an exploded perspective view of another known slider for a slide fastener provided with an automatic locking device.

The slider for the slide fastener provided with the automatic locking device according to a fourth embodiment of the invention shown in FIGS. 14 and 15 is the slider 1 of the normal type. The upper wing plate 31 and the lower wing plate 32 are connected by the guide post 33 and the flanges 34 projecting toward the lower wing plate 32 are provided on both side edges to form an element guide groove 19. Then, the front side attaching portion 15 and the rear side attaching portion 16 are built at front and rear sides of a front surface of the upper wing plate 31, each of the front side attaching portion 15 and rear side attaching portion 16 is provided with the housing groove 11, and the shelf portion 18 is projected from an inner face of the side wall 17 on each side of the housing groove 11. On a base portion of the rear side attaching portion 16, the pawl hole 20 is defined to communicate with the element guide groove 19, the projection amount regulating portion 12 is provided by projecting and raising the front wall of the pawl hole 20 upward, and the recessed portion 39 capable of mounting the pintle 8 of the pull 4 therein is formed between the front side attaching portion 15 and the rear side attaching portion 16.

The spring 5 with the locking pawl is formed into an inverted U-shape to provide the upper element 25 and the lower element 26 and the front end of the upper element 25 is bent downward to be located inside of the housing groove 11 of the rear side attaching portion 16. In addition, the pawl element 28 is provided so as to be bent on the front end side of the lower element 26, the locking pawl 27 is provided at the front end of the pawl element 28. As to an arrangement of the spring 5 with the locking pawl, the pintle 8 of the pull 4 is arranged at the recessed portion 39, the spring 5 with the locking pawl is housed in the housing grooves 11 of the front side attaching portion 15 and the rear side attaching portion 16 from the above, as shown in FIG. 15, by pressurizing the side walls 17 on both sides toward the inside of the housing grooves 11 and elastically deforming these upper end portions to be bent, the upper element 25 of the spring 5 with the locking pawl is nipped and fixed between the side walls 17 on both sides and further, when the side walls 17 are inclined, the shelf portions 18 move under the upper element 25 so that the shelf portions 18 can mount the upper element 25 thereon. On the other hand, the lower element 26 of the spring 5 with the locking pawl is formed to be capable of feely moving, the upward movement of the locking pawl 27 provided at the front end of the lower element 26 is prevented by contacting the locking pawl 27 with the rear side of the upper element 25, and this portion forms the movement regulating portion 13 for regulating the movement of the locking pawl 27 of the spring 5 with the locking pawl.

The slider for the slide fastener provided with the automatic locking device according to the present invention is formed by the body, the pull, and the spring with the locking pawl. This spring with the locking pawl can be manufactured economically merely by cutting the linear material with the same cross-sectional shape in the length direction and bending it, so that the slider of the hidden type or the normal type for the slide fastener provided with the automatic locking device can be used for various products including clothing.

What is claimed is:

1. A slider for a slide fastener provided with an automatic locking device, wherein a slider comprises a body, a pull, and a spring with a locking pawl fixed to an attaching portion of the body, a pawl element provided with a locking pawl at a front end thereof to project to an element guide groove is formed at one end of this spring with the locking pawl, the spring with the locking pawl is formed by a linear material having a same cross-sectional shape in its length direction and approximately in an inverted U-shape comprising an upper element and a lower element opposed vertically, a projection amount regulating portion for regulating a projection of the locking pawl to the element guide groove is provided on the body, the attaching portion arranged on the body is provided with a housing groove for housing the spring with the locking pawl, upper end portions of side walls on both sides of the housing groove are inclined toward an inside of the housine grooves so as to nip and fix the upper element, and the lower element comprising a pawl element on an end thereof is housed in the housing groove so as to be movable without being nipped and held by the side walls.

2. The slider for the slide fastener provided with the automatic locking device according to claim 1, wherein to projection amount regulating portion to be provided on the body is formed so as to project from the body toward the spring with the locking pawl and to elastically contact the spring with the locking pawl.

3. The slider for the slide fastener provided with the automatic locking device according to claim 2, wherein the projection amount regulating portion is formed so as to project on a top of a wall of a pawl hole for projecting a locking pawl to an element guide groove.

4. The slider for the slide fastener provided with the automatic locking device according to claim 1, wherein the housing groove for housing the spring with the locking pawl has a shelf portion projecting toward the inside of the housing groove on each of the side walls, and when the side walls on both sides are inclined, the upper element of the spring with the locking pawl is mounted on the shelf portion.

5. The slider for the slide fastener provided with the automatic locking device according to claim 1, wherein the attaching portion arranged at the body comprises a front side attaching portion and a rear side attaching portion, each of the front side attaching portion and the rear side attaching portion is respectively provided with the housing groove, an end of the upper element of the spring with the locking pawl is bent downward to form an insertion element, and a holding portion into which the insertion element is inserted so as to be held is provided at the rear side attaching portion.

6. The slider for the slide fastener provided with the automatic locking device according to claim 1, wherein the attaching portion provided at the body comprises a front side attaching portion and a rear side attaching portion, each of the front side attaching portion and the rear side attaching portion is respectively provided with a housing groove for housing the spring with the locking pawl, and the rear side attaching portion is formed lower than the front side attaching portion in a vertical direction of the body.

7. The slider for the slide fastener provided with the automatic locking device according to claim 1, wherein the attaching portion provided at the body comprises a front side attaching portion and a rear side attaching portion, each of the front side attaching potion and the rear side attaching portion is respectively provided with a housing groove for housing the spring with the locking pawl, and the front side attaching portion is formed longer than the rear side attachihg portion in a longitudinal direction of the body.

8. The slider for the slide fastener provided with the automatic locking device according to claim 1, wherein the spring with the locking pawl comprises the pawl element and a fastening element opposing on front and rear sides thereof so that the spring as a whole is approximately formed in an inverted U-shape, a housing groove is provided at a front side attaching portion, a vertical hole is formed in the housing groove for an insertion of the fastening element therein, a fastening portion is provided in the vertical hole to fix the fastening element, and upper end portions of side walls on both sides of the housing groove is bent toward an inside of the housing grooves.

9. The slider for the slide fastener provided with the automatic locking device according to claim 1, wherein the slider comprises a movement regulating portion for regulating an upward movement of the locking pawl.

* * * * *